US006328772B1

(12) United States Patent
Scott et al.

(10) Patent No.: US 6,328,772 B1
(45) Date of Patent: Dec. 11, 2001

(54) BLENDING OF SUMMER GASOLINE CONTAINING ETHANOL

(75) Inventors: William R. Scott, El Cerrito; Lewis M. Gibbs, Mill Valley, both of CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/603,901

(22) Filed: Jun. 26, 2000

Related U.S. Application Data

(63) Continuation-in-part of application No. 09/362,242, filed on Jul. 28, 1999.

(51) Int. Cl.[7] ..... C10L 1/18
(52) U.S. Cl. ..... 44/451; 208/17
(58) Field of Search ..... 44/451; 208/17

(56) References Cited

U.S. PATENT DOCUMENTS

| | | | | |
|---|---|---|---|---|
| 4,509,953 | * | 4/1985 | Itow et al. | 44/451 |
| 5,110,319 | * | 5/1992 | Turpin et al. | 44/451 |
| 5,288,393 | * | 2/1994 | Jessup et al. | 208/15 |
| 5,653,866 | * | 8/1997 | Jessup et al. | 208/16 |
| 6,030,521 | * | 2/2000 | Jessup et al. | 208/16 |

* cited by examiner

*Primary Examiner*—Jacqueline V. Howard
(74) *Attorney, Agent, or Firm*—Burns, Doane, Swecker & Mathis, LLP

(57) ABSTRACT

Provided is a method for blending an unleaded summer gasoline containing ethanol. The method comprises providing a substantially oxygenate free unleaded gasoline blend stock having an RVP of no greater than 7.0, and preferably no greater than 6.0, and then adding sufficient ethanol to the gasoline blend stock such that the ethanol addition does not cause the T50 value to drop below the ASTM D 4814 minimum requirements of 170° F.

13 Claims, 13 Drawing Sheets

ETHANOL BLENDING STUDY
BASE BLEND 5 DISTILLATION CURVES
Base Blend 5
Base + 2 Vol % EtOH
Base + 4 Vol % EtOH
Base + 6 Vol % EtOH
Base + 10 Vol % EtOH
Distillation Temperature, °F
450
400
350
300
250
200
150
100
50
0
20
40
60
80
100
Percent Evaporated

BLENDING OF SUMMER GASOLINE CONTAINING ETHANOL

CROSS-REFERENCE TO RELATED APPLICATIONS

The present application is a continuation-in-part of U.S. Ser. No. 09/362,242, filed on Jul. 28, 1999.

BACKGROUND OF THE INVENTION

1. Field of the Invention

The present invention relates to fuels, particularly gasoline fuels which contain ethanol. More specifically, the present invention relates to a method of making a summer, low-emission gasoline fuel which contains ethanol and complies with the California Code of Regulations.

2. Brief Description of the Related Art

One of the major environmental problems confronting the United States and other countries is atmospheric pollution caused by the emission of pollutants in the exhaust gases and gasoline vapor emissions from gasoline fueled automobiles. This problem is especially acute in major metropolitan areas where atmospheric conditions and the great number of automobiles result in aggravated conditions. While vehicle emissions have been reduced substantially, air quality still needs improvement. The result has been that regulations have been passed to further reduce such emissions by controlling the composition of gasoline fuels. These specially formulated, low emission gasolines are often referred to as reformulated gasolines. California's very strict low emissions gasoline is often referred to as California Phase 2 or Phase 3 gasoline. In these gasolines, oxygen-containing hydrocarbons, or oxygenates, are often blended into the fuel.

Congress and regulatory authorities, such as CARB (the California Air Resources Board), have focused on setting specifications for low emissions, reformulated gasoline. The specifications, however, require the presence of oxygenates in gasoline sold in areas that are not in compliance with federal ambient air quality standards for ozone, and the degree of non-attainment is classified as severe, or extreme. Among the emissions which the reformulated gasoline is designed to reduce, are nitrogen oxides ($NO_x$), hydrocarbons (HC), and toxics (benzene, 1,3-butadiene, formaldehyde and acetaldehyde). A reduction in these emissions has been targeted due to their obvious impact upon the air we breathe and the environment in general.

Oxygenated gasoline is a mixture of conventional hydrocarbon-based gasoline and one or more oxygenates. Oxygenates are combustible liquids which are made up of carbon, hydrogen and oxygen. All the current oxygenates used in reformulated gasolines belong to one of two classes of organic molecules: alcohols and ethers. The Environmental Protection Agency regulates which oxygenates can be added to gasoline and in what amounts.

The primary oxygen-containing compounds employed in gasoline fuels today are methyl tertiary butyl ether (MTBE) and ethanol. While oxygen is in most cases required in reformulated gasolines to help effect low emissions, the presence of ethers such as MTBE in gasoline fuels has particularly begun to raise environmental concerns. For example, MTBE has been observed in drinking water reservoirs, and in a few instances, ground water in certain areas of California. As a result, the public is beginning to question the benefits and/or importance of having an ether such as MTBE in cleaner burning gasolines, if the ether simply pollutes the environment in other ways.

Thus, while some of the concerns with regard to gasoline fuels containing ethers, could be overcome by further safe handling procedures and the operation of present facilities to reduce the risk of any spills and leaks, there remains a growing public concern with regard to the use of ethers such as MTBE in gasoline fuels. In an effort to balance the need for lower emission gasolines and concerns about the use of ethers it, therefore, would be of great benefit to the industry if a cleaner burning gasoline without ethers, which complied with the requirements of the regulatory authorities (such as CARB), could be efficiently made.

Replacing ethers such as MTBE with ethanol is one possibility to reducing the use of MTBE. However, the use of ethanol presents other problems, particularly in its handling and transportation. Transporting a gasoline containing ethanol from a refinery to a terminal, particularly through a pipeline, often results in the ethanol picking up water. This results in the final gasoline not meeting the specifications required, e.g., by the California Code of Regulations. As well, rust in the pipeline can be loosened by the ethanol, resulting in further contamination of the gasoline.

The replacement of ethers with ethanol in the blending of gasolines which meet the California Code of Regulations, therefore, still requires the need to resolve several major problems. Because of the importance ethanol is beginning to play in oxygenated gasoline, a resolution of these problems would be of great interest to the industry.

It is therefore an object of the present invention to provide a method of blending ethanol into a gasoline formulation while overcoming the foregoing problems.

It is yet another object of the present invention to provide a novel method for obtaining a gasoline formulation containing ethanol which meets the California Code of Regulations.

Yet another object of the present is to provide a method of blending a gasoline formulation containing ethanol at a site remote from the refinery, which formulation meets the California Code of Regulations.

These and other objects of the present invention will become apparent upon a review of the following description, the Figures of the Drawing, and the claims appended hereto.

SUMMARY OF THE INVENTION

In accordance with the foregoing objectives, there is provided by the present invention a method for blending unleaded gasoline containing ethanol, and having A Reid Vapor Pressure (RVP) in pounds per square inch (psi) of 8.0 or less, and more preferably 7.0 or less. The method comprises providing a substantially oxygenate free unleaded gasoline blend stock which has an RVP of no greater than 7.0, and more preferably no greater than 6.0. Ethanol is then added to the gasoline blend stock in an amount such that the final gasoline meets the California Code of Regulations, with the unleaded gasoline blend stock to which the ethanol is added having a T50 sufficiently high such that the ethanol addition does not cause the T50 value to drop below the ASTM D 4814 minimum requirement of 170° F. In a preferred embodiment, the amount of ethanol added is at least 2.0 volume percent based on the final gasoline.

Among other factors, the present invention is based upon the discovery that the addition of ethanol to a gasoline blend stock cannot be a linear addition, for the specifications of the gasoline are changed non-linearly when ethanol is added. The specifications of the gasoline blend stock must therefore be controlled in order to compensate for the addition of ethanol. This is particularly true for the RVP and T50 characteristics of the gasoline. The present invention, therefore, blends ethanol with a gasoline blend stock which has an RVP sufficiency low and a T50 specification sufficiently high such that the addition of the desired amount of ethanol results in a gasoline which is in compliance with the California Code of Regulations. It is the discovery of the need to so control the RVP and T50 specifications of the gasoline blend stock which permits one to successfully blend the ethanol into a compliant gasoline formulation.

In a preferred embodiment, the present invention allows one to blend a gasoline blend stock having predetermined RVP and T50 specifications at a refinery which does not contain ethanol, transport the blend stock through a pipeline to a terminal, and mix the ethanol and blend stock at the terminal with confidence that the final gasoline composition meets the California Code of Regulations. This method allows one to avoid the problems inherent in the transporting of an ethanol containing gasoline formulation, while meeting all required specifications for the gasoline.

DETAILED DESCRIPTION OF THE PREFERRED EMBODIMENTS OF THE INVENTION

Figure 1:
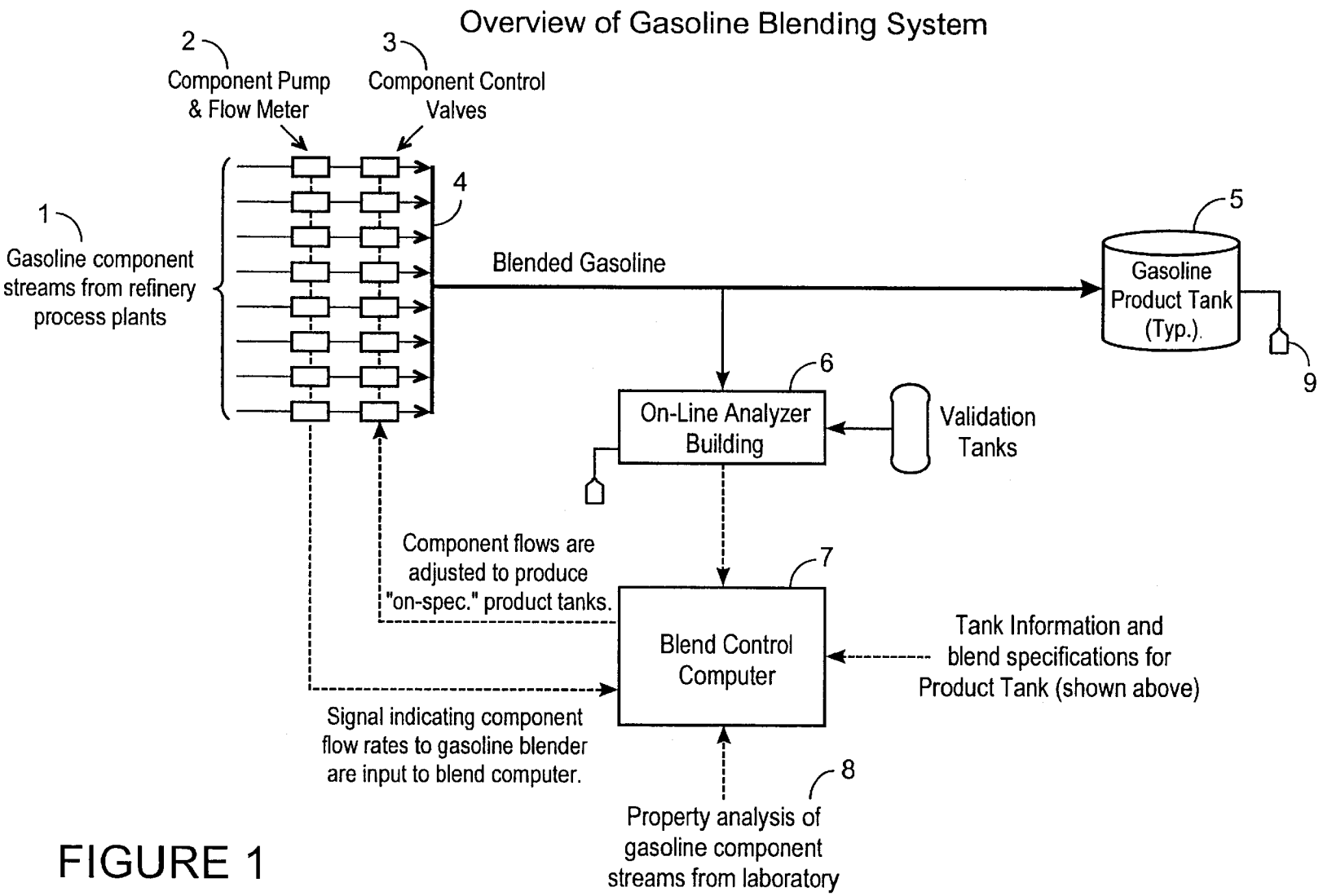
FIG. 1 schematically depicts a gasoline blending system useful in preparing the blend stock of the present invention.
Figure 2:
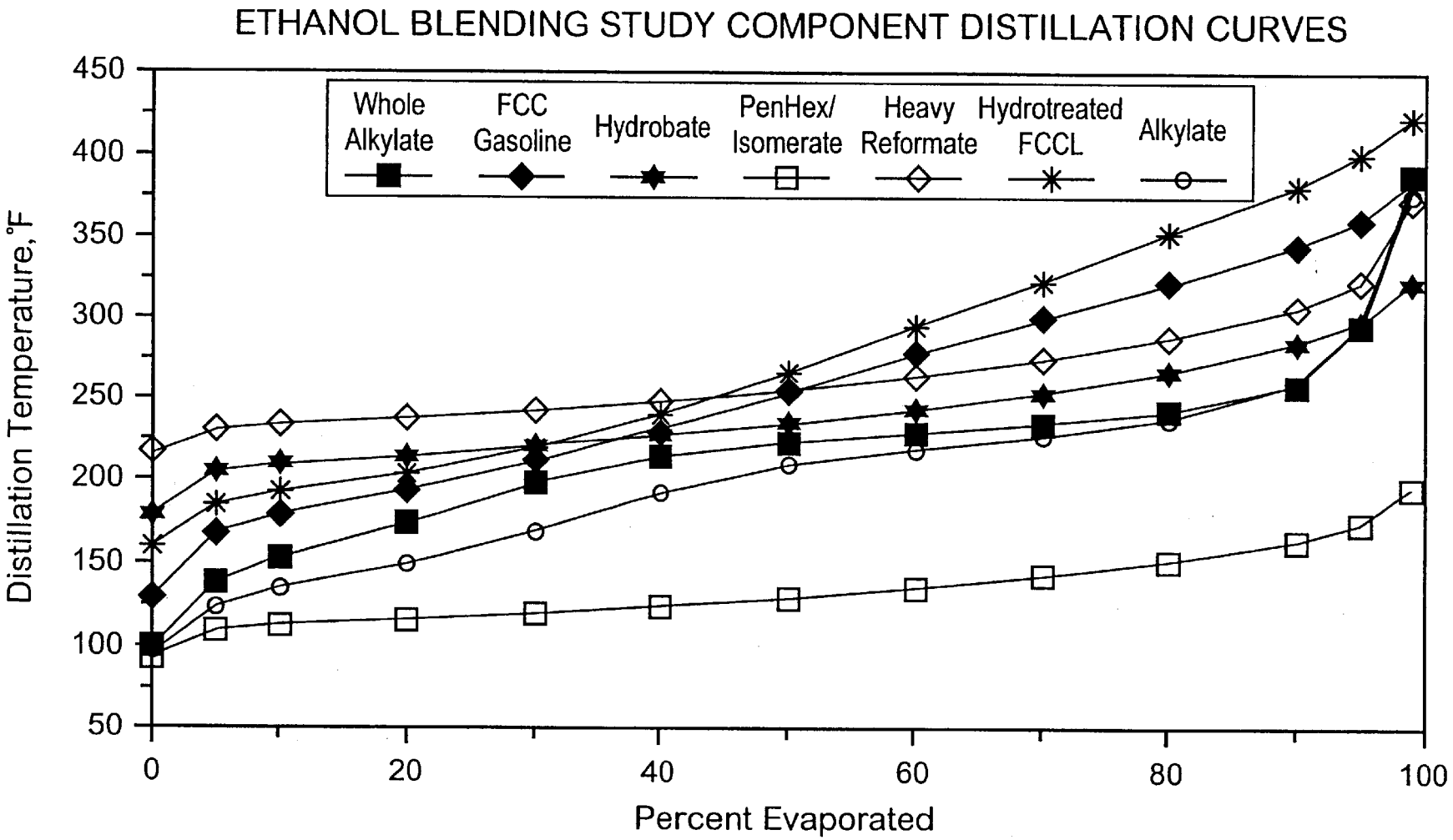
FIG. 2 graphically depicts the distillation curves for the gasoline blending components.
Figure 3:
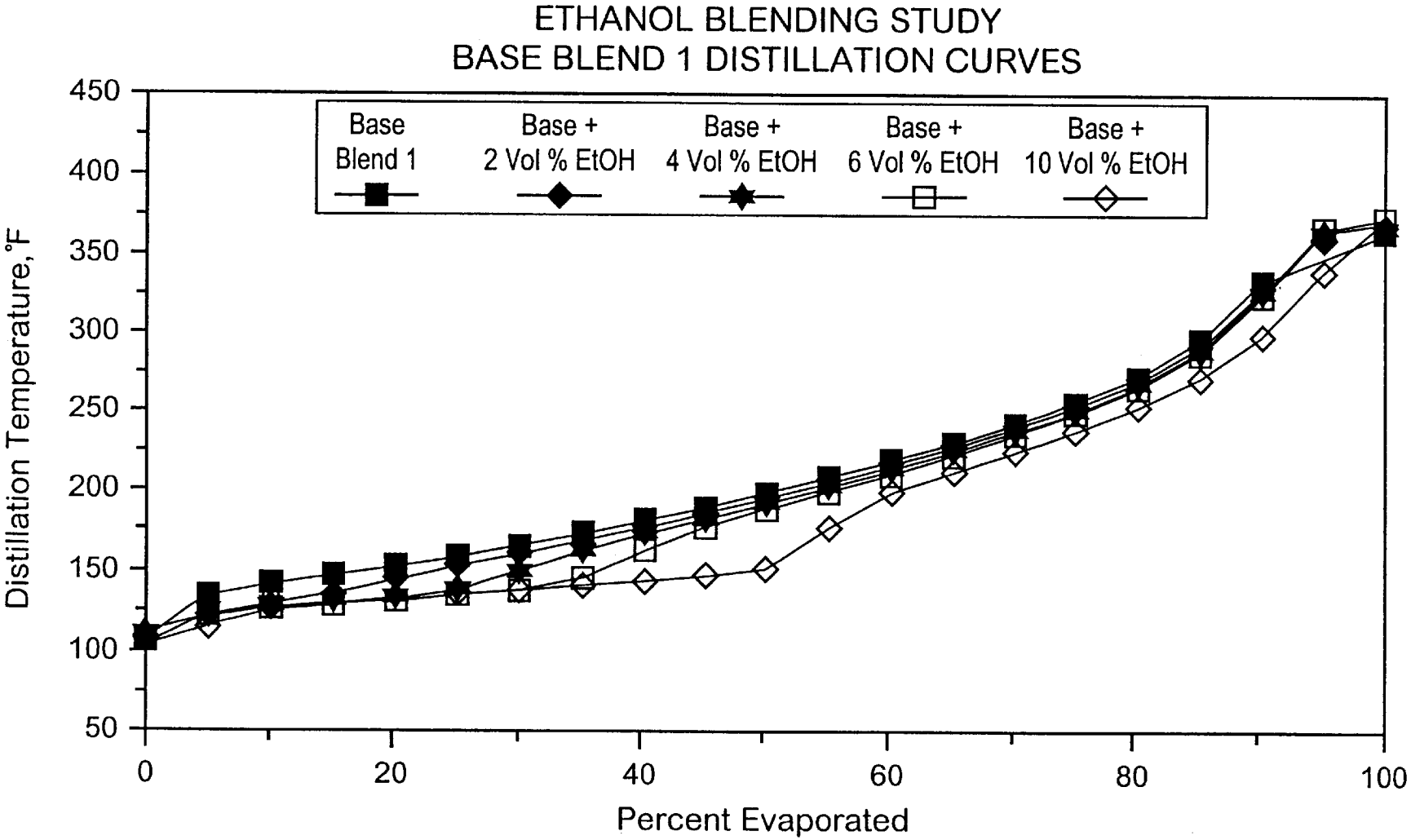
FIG. 3 graphically depicts the distillation curves for a gasoline blend stock blended with various amounts of ethanol.
Figure 4:
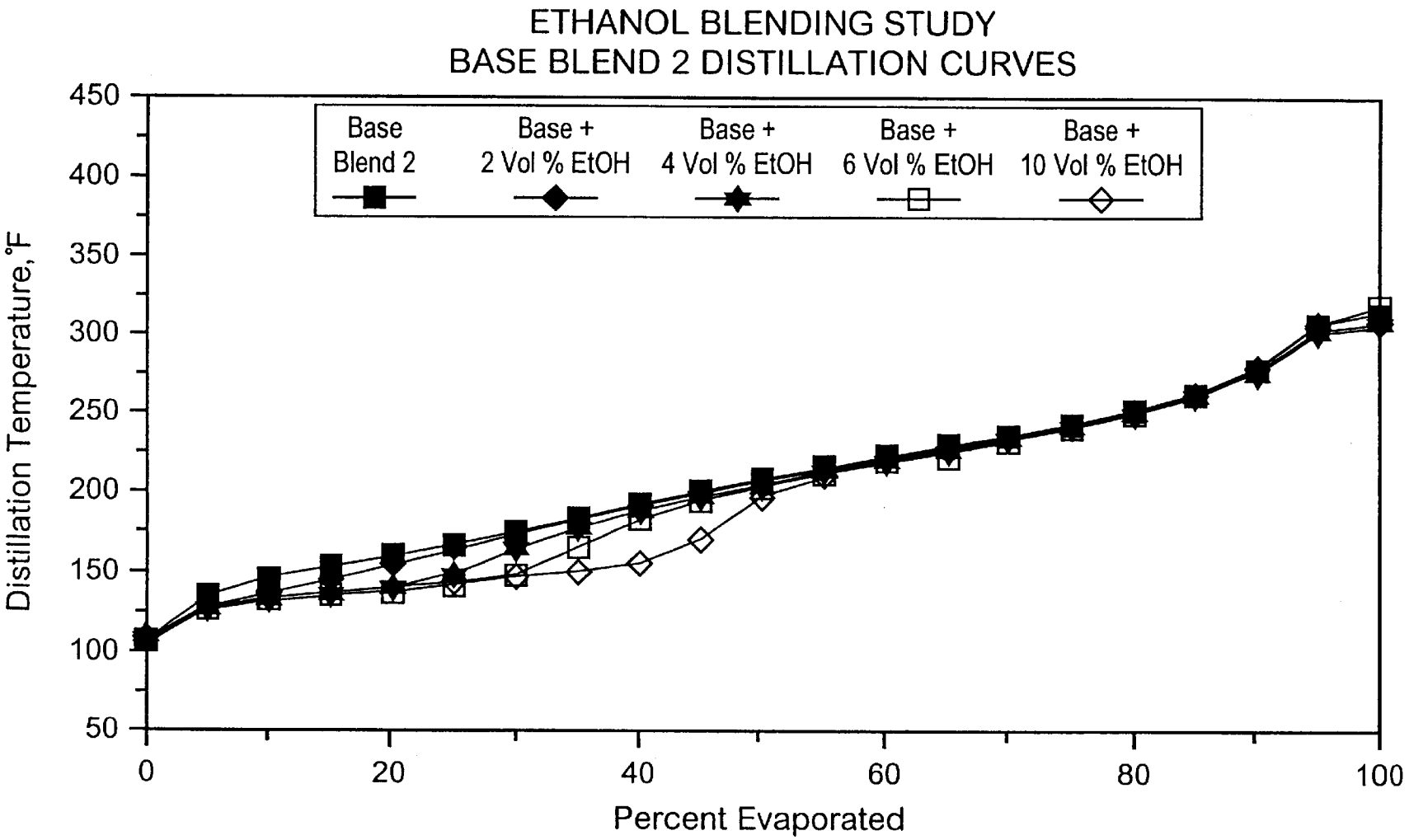
FIG. 4 graphically depicts the distillation curves, for another gasoline blend stock blended with various amounts of ethanol.
Figure 5:
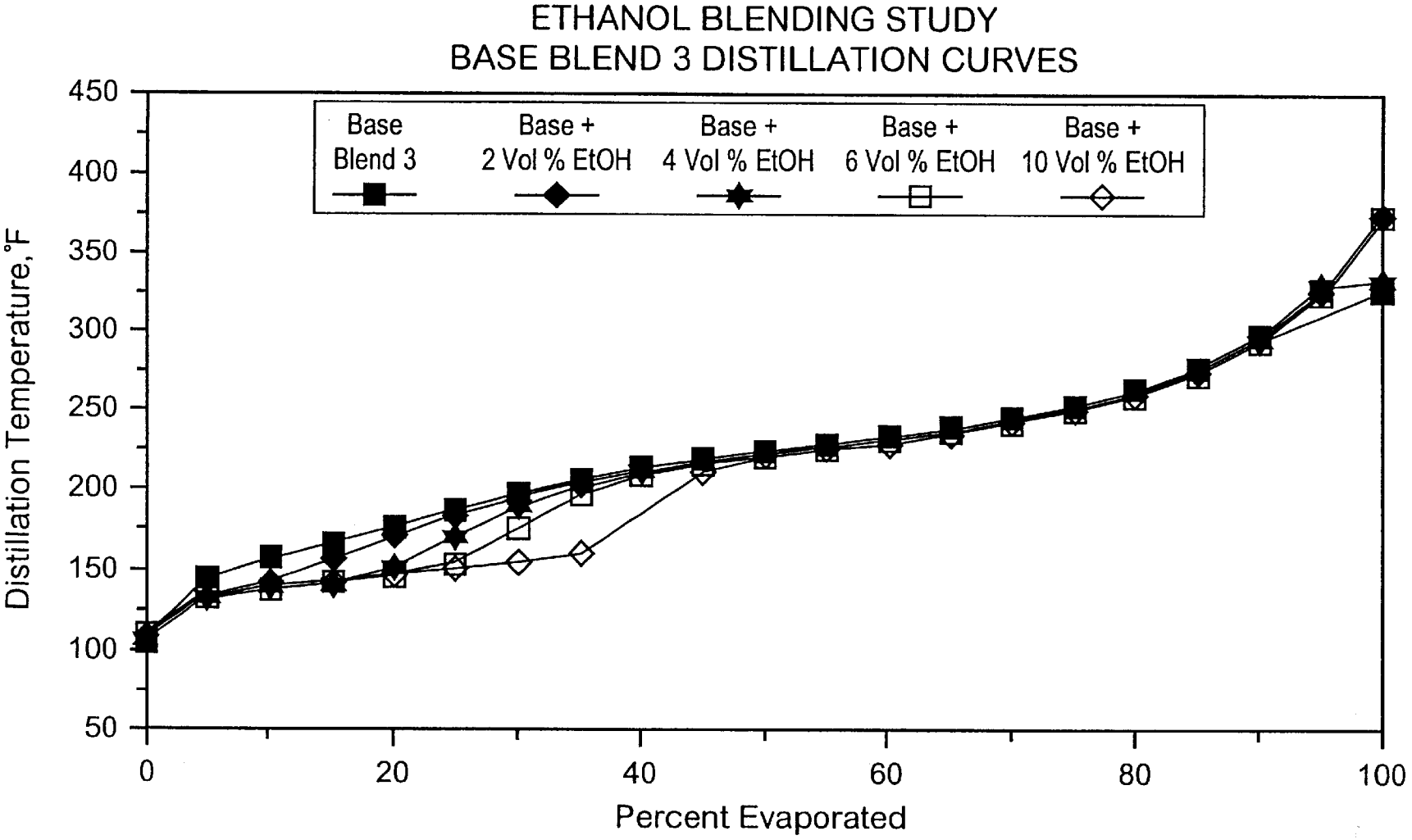
FIG. 5 graphically depicts the distillation curves, for another gasoline blend stock blended with various amounts of ethanol.
Figure 6:
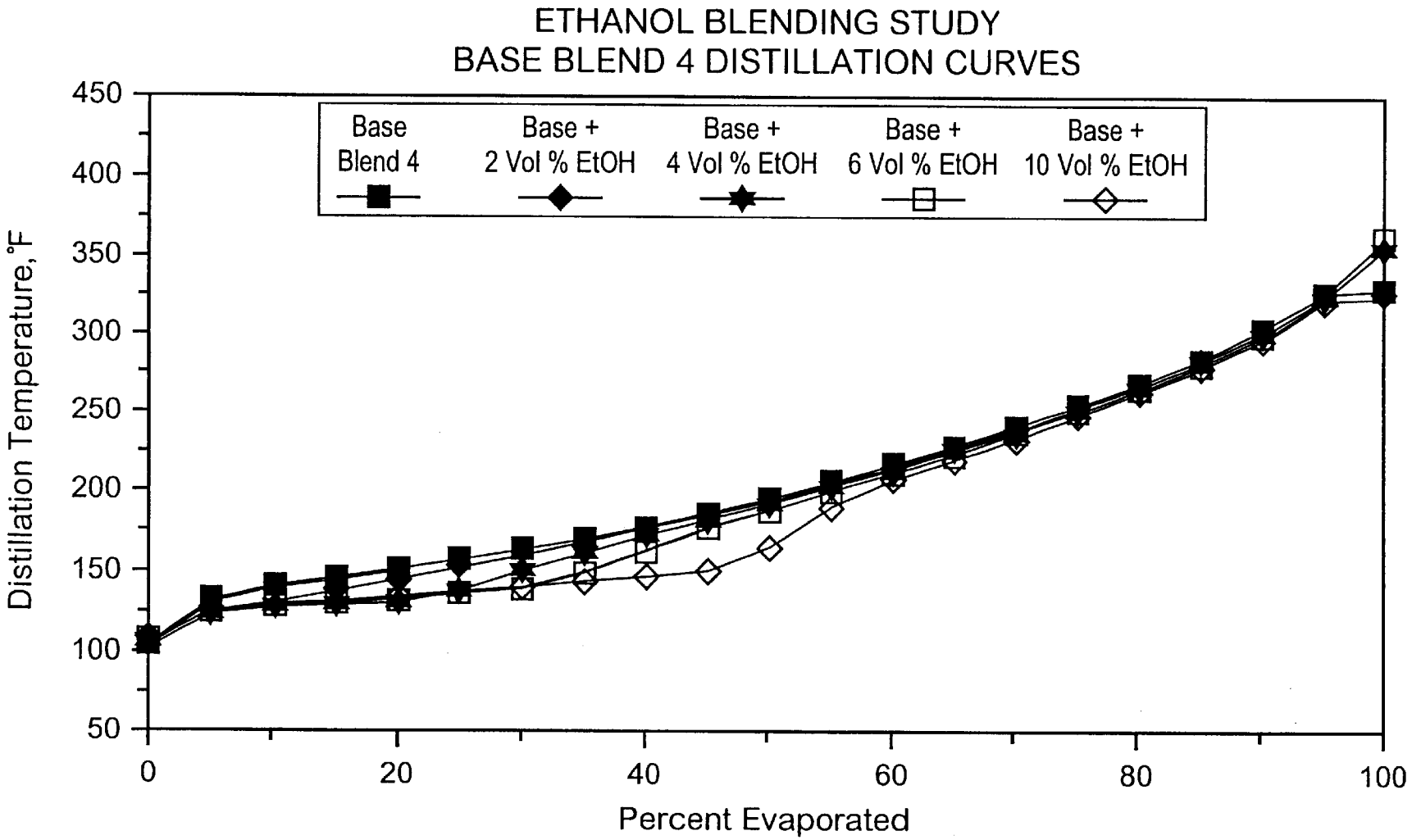
FIG. 6 graphically depicts the distillation curves, for another gasoline blend stock blended with various amounts of ethanol.
Figure 7:
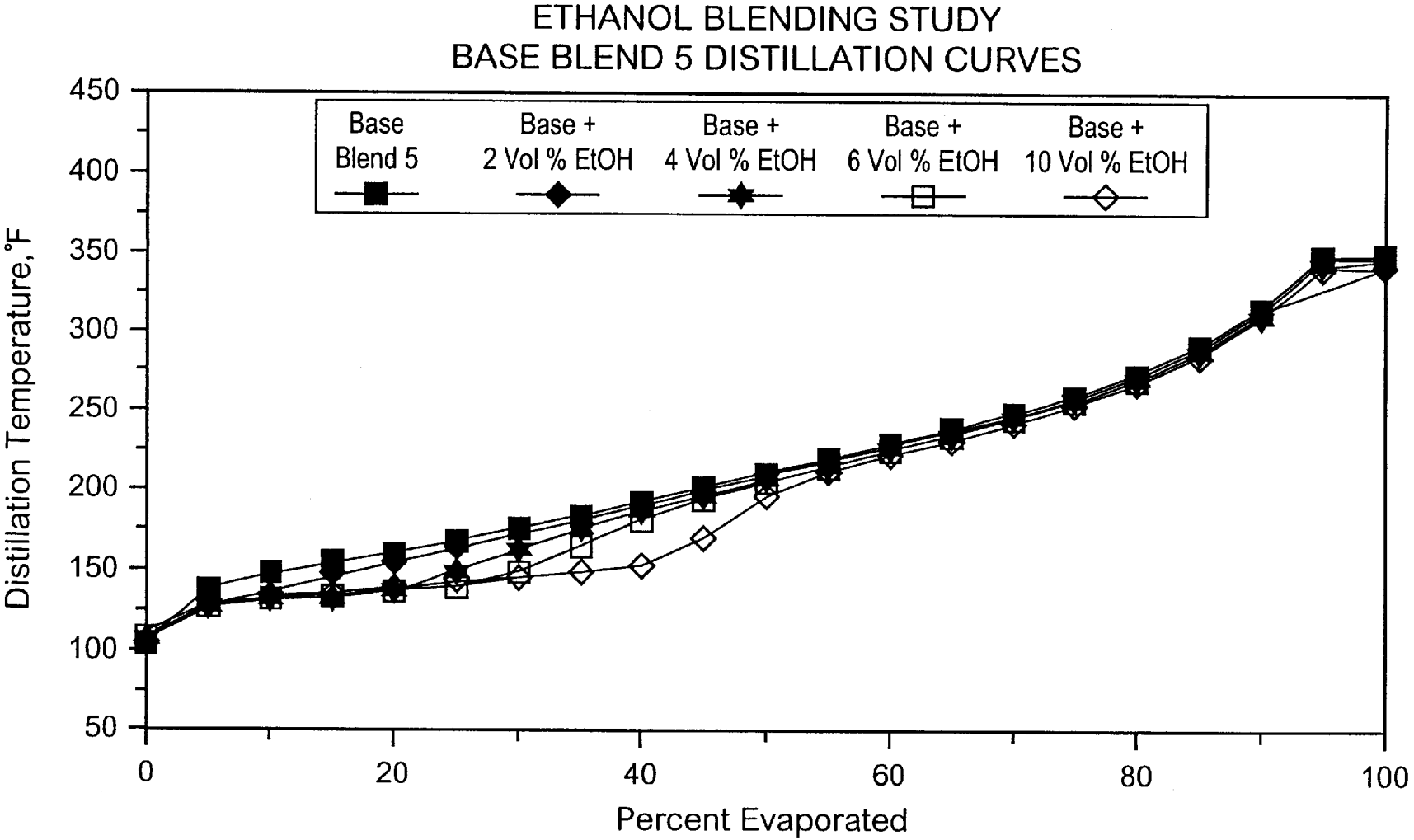
FIG. 7 graphically depicts the distillation curves, for another gasoline blend stock blended with various amounts of ethanol.
Figure 8:
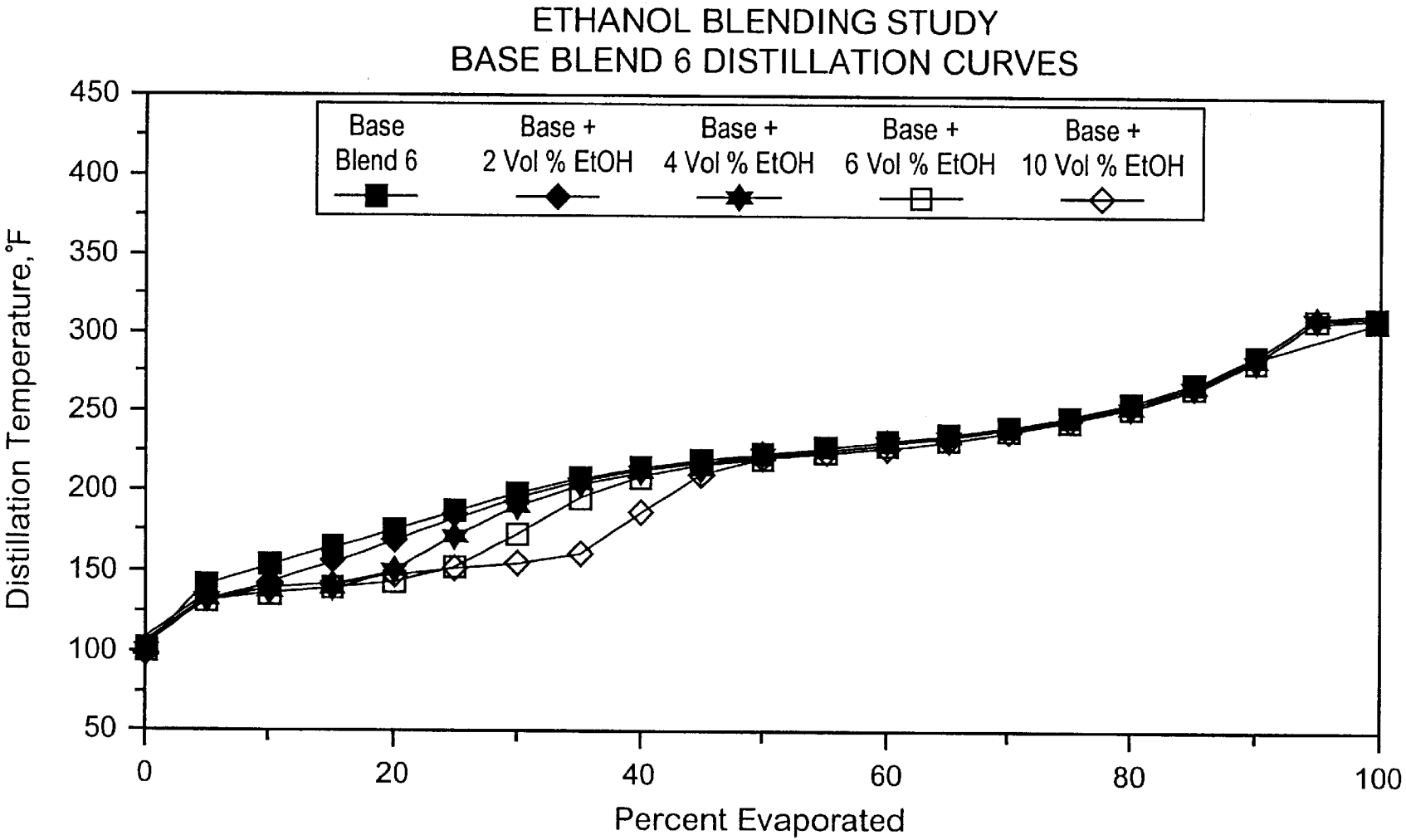
FIG. 8 graphically depicts the distillation curves, for another gasoline blend stock blended with various amounts of ethanol.
Figure 9:
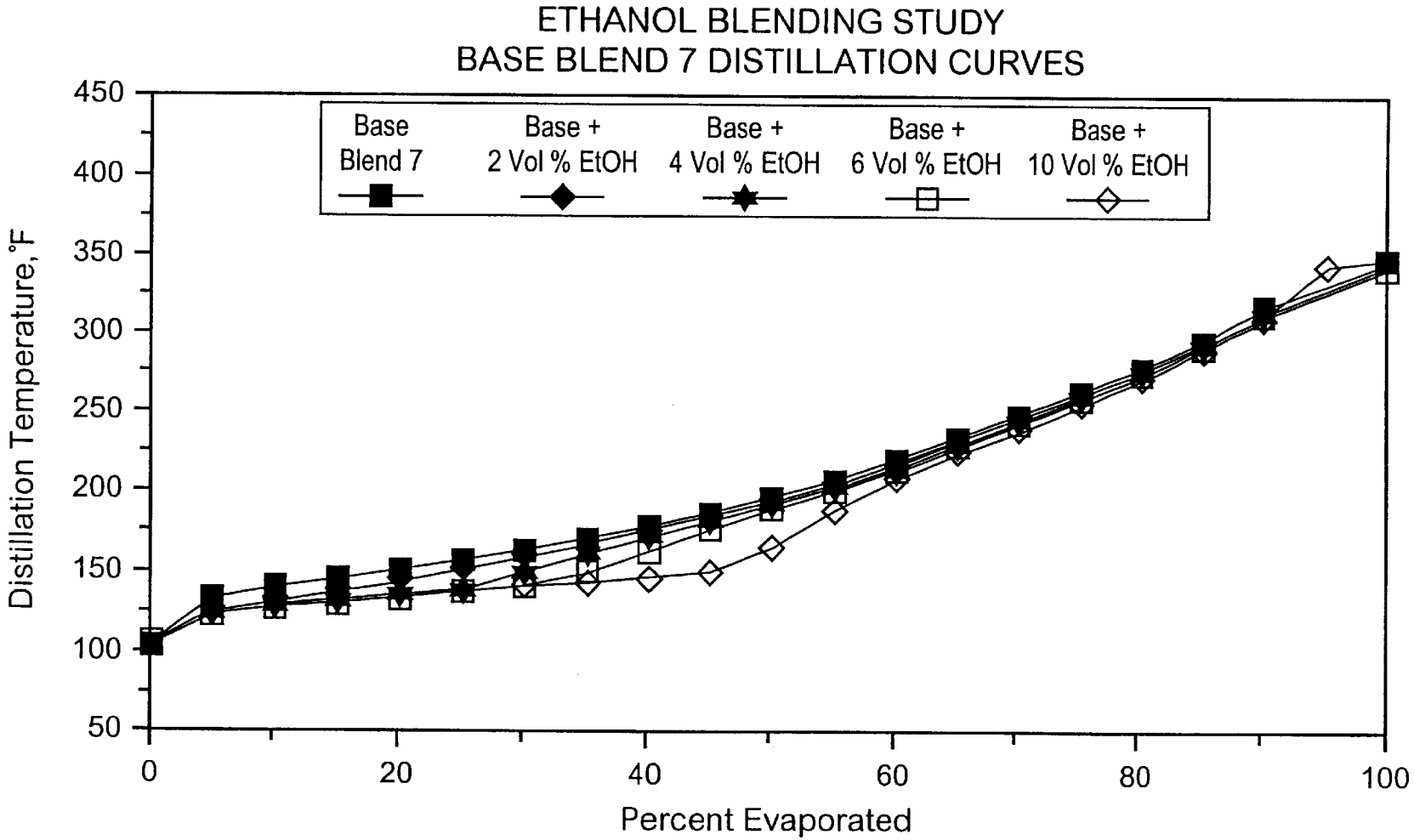
FIG. 9 graphically depicts the distillation curves, for another gasoline blend stock blended with various amounts of ethanol.
Figure 10:
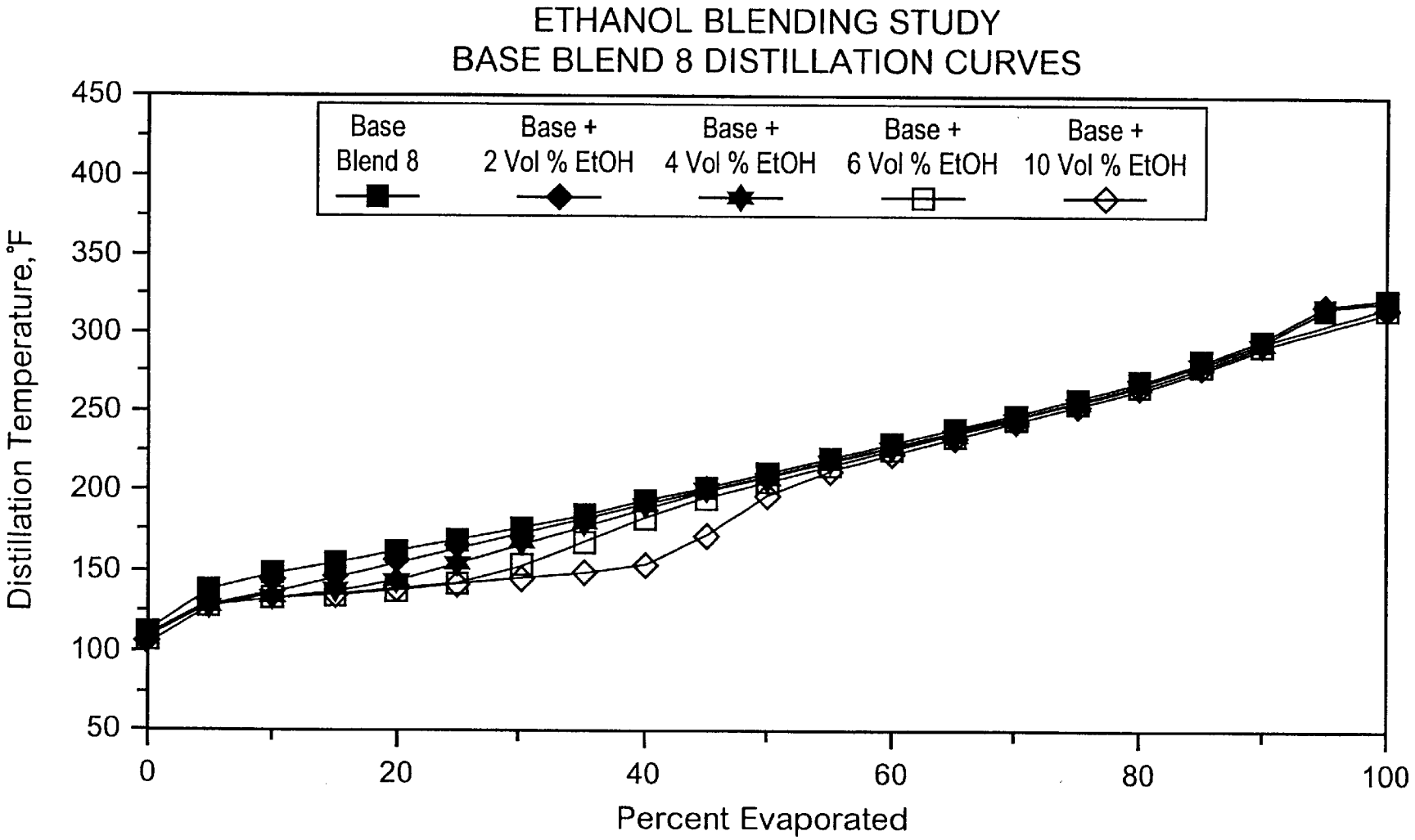
FIG. 10 graphically depicts the distillation curves, for another gasoline blend stock blended with various amounts of ethanol.
Figure 11:
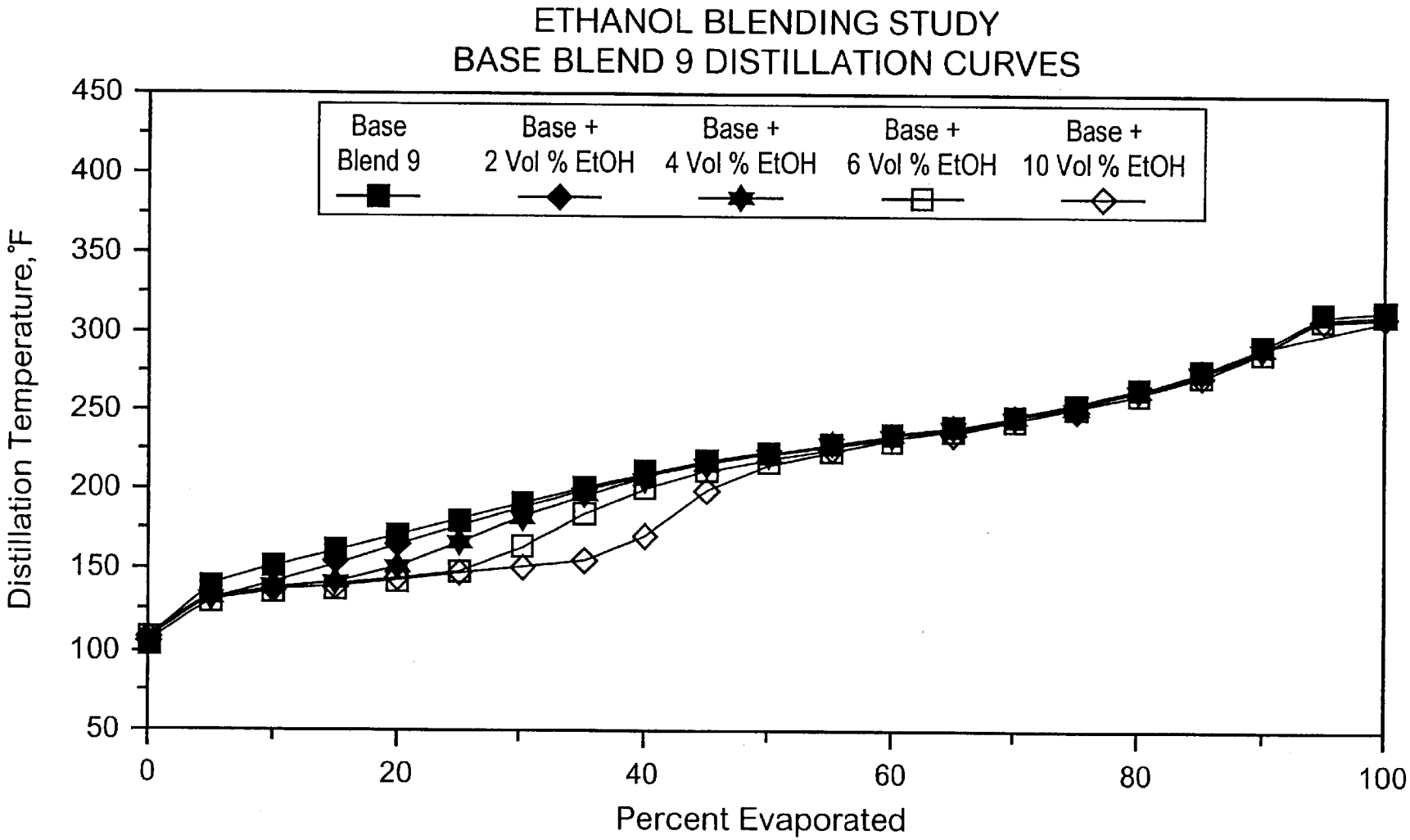
FIG. 11 graphically depicts the distillation curves, for another gasoline blend stock blended with various amounts of ethanol.
Figure 12:
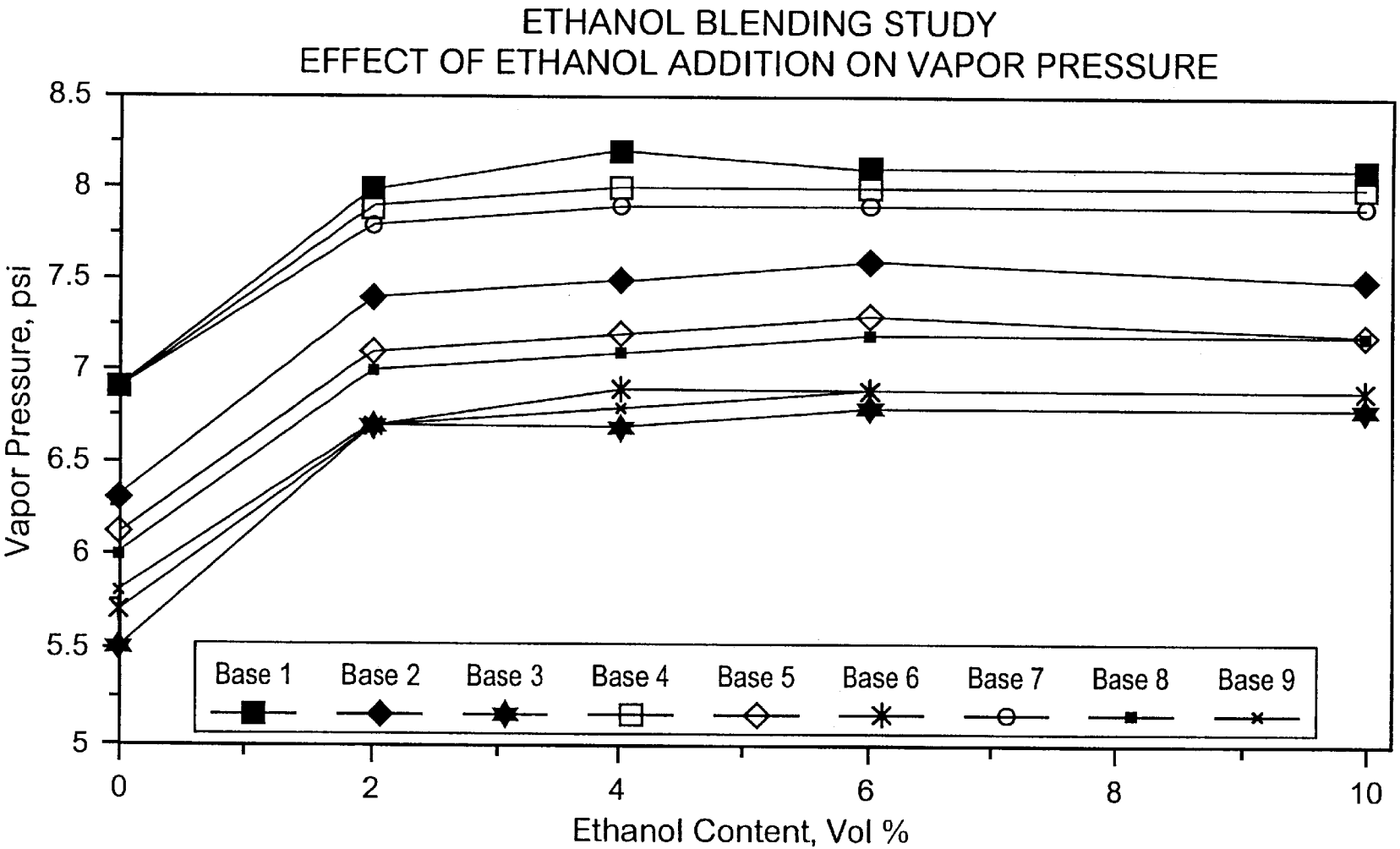
FIG. 12 graphically depicts the vapor pressure curves for gasoline blend stocks blended with various amounts of ethanol.
Figure 13:
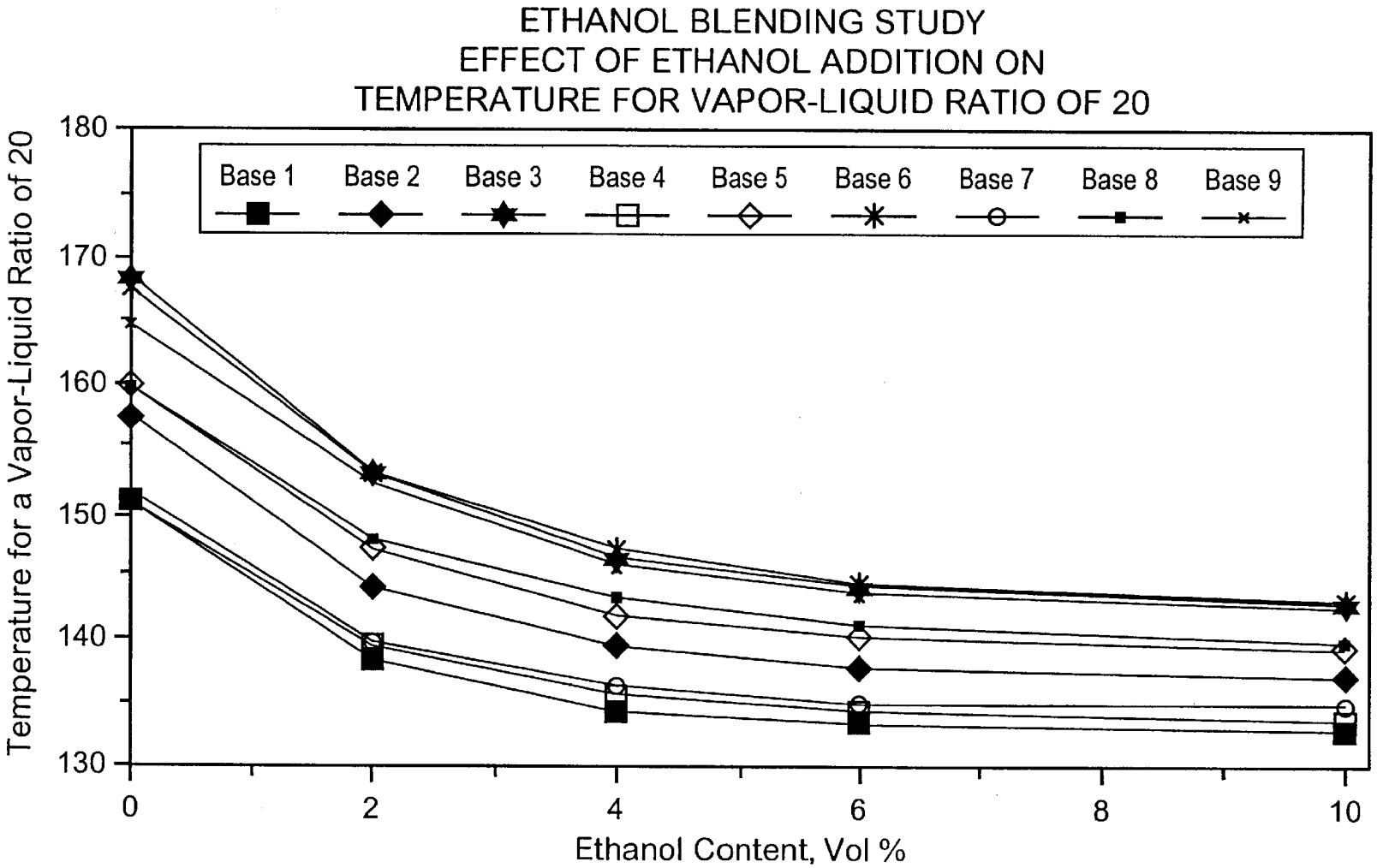
FIG. 13 graphically depicts the temperature for vapor-liquid ratio of 20 curves or gasoline blend stocks blended with various amounts of ethanol.

Gasolines are well known fuels, generally composed of a mixture of numerous hydrocarbons having different boiling points at atmospheric pressure. Thus, a gasoline fuel boils or distills over a range of temperatures, unlike a pure compound. In general, a gasoline fuel will distill over the range of from about, room temperature to 437° F. (225° C.). This temperature range is approximate, of course, and the exact range will depend on the conditions that exist in the location where the automobile is driven. The distillation profile of the gasoline can also be altered by changing the mixture in order to focus on certain aspects of gasoline performance, depending on the time of year and geographic location in which the gasoline will be used.

Gasolines are therefore, typically composed of a hydrocarbon mixture containing aromatics, olefins, naphthenes and paraffins, with reformulated gasoline most often containing an oxygen compound. The fuels contemplated in the present invention are substantially ether free unleaded gasolines (herein defined as containing a concentration of lead no greater than 0.05 gram of lead per gallon which is 0.013 gram of lead per liter), which contain ethanol as the oxygen compound. The anti-knock value (R+M)/2 for regular gasoline is generally at least 87, at least 89 for mid-range, and for premium at least 91, and generally at least 92.

In an attempt to reduce harmful emissions upon the combustion of gasoline fuels, regulatory boards as well as Congress have developed certain specifications for reformulated gasolines. One such regulatory board is that of the State of California, i.e., the California Air Resources Board (CARB). In 1991, specifications were developed by CARB for California gasolines which, based upon testing, should provide good performance and low emissions. The specifications and properties of the reformulated gasoline, which is referred to as the Phase 2 reformulated gasoline or California Phase 2 gasoline, are shown in Table 1 below.

TABLE 1

Properties and Specifications for Phase 2 Reformulated Gasoline

| Fuel Property | Units | Flat Limit | Averaging Limit | Cap Limit |
|---|---|---|---|---|
| Reid vapor pressure (RVP) | psi, max. | 7.00[1] | | 7.00[1] |
| Sulfur (SUL) | ppmw | 40 | 30 | 80 |
| Benzene (BENZ) | vol. %, max. | 1.00 | 0.80 | 1.20 |
| Aromatic HC (AROM) | vol. %, max. | 25.0 | 22.0 | 30.0 |
| Olefin (OLEF) | vol. %, max. | 6.0 | 4.0 | 10.0 |
| Oxygen (OXY) | wt. % | 1.8 (min)<br>2.2 (max) | | 0 (min)<br>3.5 (max) |
| Temperature at 50% distilled (T50) | deg. F. | 210 | 200 | 220 |
| Temperature at 90% distilled (T90) | deg. F. | 300 | 290 | 330 |

[1]Applicable during the summer months identified in 13 CCR, sections 2262.1 (a) and (b); California requires adherence to ASTM specifications.

Recently, Phase 3 regulations have been developed. At present, the gasoline can meet either Phase 2 or Phase 3 regulations, but beginning Jan. 1, 2003, Phase 3 regulations must be met. The specifications and properties of the reformulated California Phase 3 gasoline are shown in Table 2 below:

TABLE 2

Properties and Specifications for Phase 3 Reformulated Gasoline

| Fuel Property | Units | Flat Limit | Average Limit | Cap Limit |
|---|---|---|---|---|
| Reid vapor pressure (RVP) | psi, max. | 7.00 | | 6.40–7.20[1] |
| Sulfur (SUL) | ppmw | 20 | 15 | 60[2]/30[3] |
| Benzene (BENZ) | vol. %, max | 0.80 | 0.70 | 1.10 |
| Aromatic HC (AROM) | vol. %, max | 25.0 | 22.0 | 35.0 |
| Olefin (OLEF) | vol. %, max | 6.0 | 4.0 | 10.0 |
| Oxygen (OXY) | wt. % | 1.8 (min) 2.2 (max) | | 3.7[4] |
| Temperature at 50% distilled (T50) | deg. F. | 213 | 203 | 220 |
| Temperature at 90% distilled (T90) | deg. F. | 305 | 295 | 330 |

[1]Applicable during the summer months identified in 13 CCR, Sections 2262, 1(a) and (b); California requires adherence to ASTM specifications.
[2]1/1/2003–12/31/2004.
[3]Beginning 1/1/2005.
[4]For ethanol only.

In Tables 1 and 2, as well as for the rest of the specification, the following definitions apply:

Aromatic hydrocarbon content (Aromatic HC, AROM) means the amount of aromatic hydrocarbons in the fuel expressed to the nearest tenth of a percent by volume in accordance with 13 CCR (California Code of Regulations), section 2263.

Benzene content (BENZ) means the amount of benzene contained in the fuel expressed to the nearest hundredth of a percent by volume in accordance with 13 CCR, section 2263.

Olefin content (OLEF) means the amount of olefins in the fuel expressed to the nearest tenth of a percent by volume in accordance with 13 CCR, section 2263.

Oxygen content (OXY) means the amount of actual oxygen contained in the fuel expressed to the nearest tenth of a percent by weight in accordance with 13 CCR, section 2263.

Potency-weighted toxics (PWT) means the mass exhaust emissions of benzene, 1,3-butadiene, formaldehyde, and acetaldehyde, each multiplied by their relative potencies with respect to 1,3-butadiene, which has a value of 1.

Predictive model means a set of equations that relate emissions performance based on the properties of a particular gasoline formulation to the emissions performance of an appropriate baseline fuel.

Reid vapor pressure (RVP) means the vapor pressure of the fuel expressed to the nearest hundredth of a pound per square inch in accordance with 13 CCR, section 2263.

Sulfur content (SUL) means the amount by weight of sulfur contained in the fuel expressed to the nearest part per million in accordance with 13 CCR, section 2263.

50% distillation temperature (T50) means the temperature at which 50% of the fuel evaporates expressed to the nearest degree Fahrenheit in accordance with 13 CCR, section 2263.

90% distillation temperature (T90) means the temperature at which 90% of the fuel evaporates expressed to the nearest degree Fahrenheit in accordance with 13 CCR, section 2263.

Toxic air contaminants means exhaust emissions of benzene, 1,3-butadiene, formaldehyde, and acetaldehyde.

The pollutants addressed by the foregoing specifications include oxides of nitrogen ($NO_x$), and hydrocarbons (HC), which are generally measured in units of g/mile, and potency-weighted toxics (PWT), which are generally measured in units of mg/mile.

The California Phase 2 and Phase 3 reformulated gasoline regulations define a comprehensive set of specifications for a gasoline (Tables 1 and 2). These specifications have been designed to achieve large reductions in emissions of criteria and toxic air contaminants from gasoline-fueled vehicles. Gasolines which do not meet the specifications are believed to be inferior with regard to the emissions which result from their use in vehicles. All gasolines sold in California, beginning Jun. 1, 1996, have had to meet CARB's Phase 2 requirements as described below, and beginning Jan. 1, 1993, Phase 3 regulations must be met. The specifications address the following eight gasoline properties:

Reid vapor pressure (RVP)

Sulfur

Oxygen

Aromatic hydrocarbons

Benzene

Olefins

Temperature at which 90 percent of the fuel has evaporated (T90)

Temperature at which 50 percent of the fuel has evaporated (T50)

The Phase 2 and Phase 3 gasoline regulations include gasoline specifications that must be met at the time the gasoline is supplied from the production facility. Producers have the option of meeting either "flat" limits or, if available, "averaging" limits, or, alternatively a Predictive Model equivalent performance standard using either the "flat" or "averaging" approach.

The flat limits must not be exceeded in any gallon of gasoline leaving the production facility when using gallon compliance. For example, the aromatic content of gasoline, subject to the default flat limit, could not exceed 25.0 volume percent (see Tables 1 and 2).

The averaging limits for each fuel property established in the regulations are numerically more stringent than the comparable flat limits for that property. Under the averaging option, the producer may assign differing "designated alternative limits" (DALs) to different batches of gasoline being supplied from the production facility. Each batch of gasoline must meet the DAL assigned for the batch. In addition, a producer supplying a batch of gasoline with a DAL less stringent than the averaging limit must, within 90 days before or after, supply from the same facility sufficient quantities of gasoline subject to more stringent DALs to fully offset the exceedances of the averaging limit. Therefore, an individual batch may not meet the California Phase 2 or Phase 3 Predictive Model when using averaging, but in aggregate, over time, they must.

The Phase 2 and Phase 3 gasoline regulations also contain "cap" limits. The cap limits are absolute limits that cannot be exceeded in any gallon of gasoline sold or supplied throughout the gasoline distribution system. These cap limits are of particular importance when the California Predictive Model or averaging is used.

A mathematical model, the California Predictive Model, has also been developed by CARB to allow refiners more flexibility. Use of the predictive model is designed to allow producers to comply with the Phase 2 or Phase 3 gasoline requirements by producing gasoline to specifications different from either the averaging or flat limit specifications set forth in the regulations. However, producers must demonstrate that the alternative Phase 2 or Phase 3 gasoline specifications will result in equivalent or lower emissions compared to Phase 2 or Phase 3 gasoline meeting either the flat or averaging limits as indicated by the Predictive Model. Further, the cap limits must be met for all gasoline formulations, even alternative formulations allowed under the California Predictive Model. When the Predictive Model is used, the eight parameters of Tables 1 and 2 are limited to the cap limits.

In general, the California Predictive Model is a set of mathematical equations that allows one to compare the expected exhaust emissions performance of a gasoline with a particular set of fuel properties to the expected exhaust emissions performance of an appropriate gasoline fuel. One or more selected fuel properties can be changed when making this comparison.

Generally, in a predictive model, separate mathematical equations apply to different indicators. For example, a mathematical equation could be developed for an air pollutant such as hydrocarbons; or, a mathematical equation could be developed for a different air pollutant such as the oxides of nitrogen.

Generally, a predictive model for vehicle emissions is typically characterized by:

the number of mathematical equations developed, the number and type of motor vehicle emissions tests used in the development of the mathematical equations, and the mathematical or statistical approach used to analyze the results of the emissions tests.

The California Predictive Model is comprised of eighteen (18) mathematical equations. One set of six equations predicts emissions from vehicles in Technology Class 3 (model years 1981–1985), another set of six is for Technology Class 4 (model years 1986–1995), and another set for Technology Class 5 (model years 1996–2005). For each technology class, one equation estimates the relative amount of exhaust emissions of hydrocarbons, the second estimates the relative amount of exhaust emissions of oxides of nitrogen, and four are used to estimate the relative amounts of exhaust emissions of the four toxic air contaminants: benzene, 1,3-butadiene, acetaldehyde, and formaldehyde. These toxic air contaminants are combined based on their relative potential to cause cancer, which is referred to as potency-weighting.

In creating the California Predictive Model, CARB compiled and analyzed the results of over 7,300 vehicle exhaust emissions tests. A standard statistical approach to develop the mathematical equations to estimate changes in exhaust emissions was used based upon the data collected. It is appreciated that the California Predictive Model might change with regard to certain of the components considered, and their limits. In fact, at present, as discussed above, there exists a California Phase 2 and a California Phase 3 Predictive Model. However, it is believed that the present invention and its discovery that a blending process can be used to effectively create the gasolines of the present invention, can be used to blend a gasoline in compliance with the specifications of any California Predictive Model.

In summary, specific requirements were created by the California Air Resources Board to restrict the formulation of gasoline to ensure the production of gasoline which produces low emissions when used in automobiles.

The present invention provides one with a method of blending a low emission, ether free gasoline economically and in a commercially plausible manner, which gasoline has an RVP suitable for the summer season. The gasoline obtained is in compliance with the California Code of Regulations for reformulated gasoline and the California Predictive Model, at present, either the Phase 2 or Phase 3 Predictive Model, and it contains substantially no ethers. The gasoline is also in compliance with ASTM D 4814.

By substantially free of ethers, for the present invention, is meant that there is less than 0.1 wt. %, more preferably less than 0.05 wt. %, and most preferably less than 0.01 wt. % of oxygen attributed to ether compounds in the blended gasoline. The gasoline does contain ethanol as a substantial replacement for the ether such as MTBE.

The gasoline of the present invention is also most preferably low in sulfur content, with the sulfur content being about 30 ppm wt. or less. It is preferred that the sulfur content is less than 20 ppm, more preferably less than 15 ppm wt., even more preferably less than 10 ppm wt., more preferably less than 5 ppm wt., and most preferably less than 1 ppm wt. The amount of sulfur can be controlled by specifically choosing streams which are low in sulfur for blending in the gasoline. It has been found that the use of low sulfur permits one to more easily and economically blend a gasoline with low emissions. Thus, the low sulfur content is a preferred aspect of the present invention.

The final gasoline compositions of the present invention also preferably have a T50 of less than 210° F., or preferably less than 200° F., and most preferably about 185° F. or less, when Phase 2 gasoline is being blended, preferably less than 203° F., more preferably less than 200° F., and most preferably less than 190° F. if Phase 3 gasoline is being blended. The olefin content is also less than 8 vol. %, more preferably less than 6 vol. %, and most preferably less than 3 vol. %. The amount of benzene is also less than 0.7 vol. % and less than 0.5 vol. % in the most preferred embodiment.

As the gasoline of the present invention is designed for the summer months, the RVP is generally lower. The RVP is generally about 8.0 or less, and more preferably about 7.2 or 7.0 or less.

The gasoline of the present invention can also be blended to achieve any octane rating (R+M)/2 desired. A regular gasoline with an octane rating of at least 87, a mid-grade gasoline with an octane rating of at least 89 or 90, or a premium gasoline with an octane rating of at least 91 can all be prepared in accordance with the present invention.

The method of the present invention comprises continuously blending gasoline component streams from a refinery process plant to prepare a gasoline blend stock. The blend stock will generally have an RVP value no greater than 5.5 to 7.0 psi, more preferably in the range of from about 5.5 to 6.5, and most preferably an RVP of about 6.0 or less, e.g., in the range of from about 5.5 to 6.0; and, a T50 value sufficiently high such that the addition of ethanol does not cause the T50 value to drop below the ASTM D 4814 minimum requirement of 170° F. Generally the T50 value for the blend stock is at least 190° F. Any of the conventional gasoline component streams which are blended into gasolines can be used.

A preferred blend stock gasoline composition of the present invention has an RVP of less than 6.0 psi, a T50 value of greater than 190° F., and a sulfur content of no greater than 30 ppm wt. sulfur, more preferably less than 20 ppm wt. sulfur, and most preferably less than 10 ppm wt. sulfur. The amount of ethanol that is blended with such a blend stock is preferably in the range of from 2.0 to 6.0 vol. %.

The specific amount of ethanol that can be blended with a particular blend stock can be determined by creating a model from a number of runs as shown in the examples. Once such a model is created, the desired amount of ethanol can be determined and blended according to the model in order to meet the RVP and T50 California Code requirements in accordance with the model.

A schematic of a suitable system for blending the gasoline blend stock is shown in FIG. 1 of the Drawing. The gasoline component streams are provided at 1, and flow through component pump and flow meters 2. Component control valves 3 control how much of each stream is let into the blending process 4, to create the blended gasoline. The blended gasoline is then generally stored in a gasoline product tank 5.

To begin the process, a blending model can be used to approximate the blending of the gasoline feed stock. Such blending models can be created via experience of blending gasoline feed stocks together with ethanol. Such experience can be gained from the examples which follow.

It is generally important to include an analysis of the blended gasoline feed stock. Such testing can be periodic or continuous. In general, it is preferred to use an on-line analyzer as shown at 6. Generally, the analysis run involves the entire boiling range of the gasoline, including T50 and T90, the RVP of the blended gasoline, the benzene/aromatics content and the sulfur content. The tests run can be as follows:

For distillation, the analyzer utilizes an Applied Automation Simulated Distillation Motor Gasoline Gas Chromatograph. This analyzer is similar to the instrument described in ASTM D 3710-95: Boiling Range Distribution of Gasoline by Gas Chromatography. This test method is designed to measure the entire boiling range of gasoline, either high or low Reid Vapor Pressures, and has been validated for gasolines containing the oxygenates methyl tertiary butyl ether (MTBE) and tertiary amul methyl either (TAME). Alternatively, the ASTM D 86 distillation method can be used, although not preferred for an on-line analyzer. Either test can be run.

Measuring RVP utilizes an ABB Model 4100 Reid Vapor Pressure Analyzer. This analyzer is described in ASTM D 5482-96. This is a substitute for the "CARB RVP" calculation based on the Dry-Vapor Pressure result from D 5191, which is itself a substitute for ASTM method 393-89. Either can be used.

The method for measuring benzene and aromatic content can utilize the Applied Automation Standard Test Method for Determination of Benzene, Toluene, C8 and Heavier Aromatics, and Total Aromatics in Finished Motor Gasoline Gas Chromatograph. The analyzer is similar to the instrument described in ASTM D 5580-95: Standard Tests Method for Determination of Benzene, Toluene, Ethylbezene, p/m-Xylene, C9 and Heavier Aromatics, and Total Aromatics in Finished Gasoline by Gas Chromatography. This is a substitute for ASTM D 5580 and ASTM D 1319 (for aromatics) and ASTM D 3606 (for benzene) methods which methods can also be used.

Olefin content can be measured using any suitable method. ASTM D 1319 is presently preferred. Other methods can also be used.

For measurement of sulfur content, the analyzer can utilize an ABB Model 3100 Sulfur in Gasoline Gas Chromatograph. The method is designed to quantify the amount of sulfur in a hydrocarbon steam as a substitute for the ASTM D 2622 or D 5453-93 method, which can also be used.

The information from the analysis is then fed to a computer 7 which can control the component flows to produce a gasoline blend which complies with a California Predictive Model for the summer season. The information provided to the computer can comprise information from on-line analysis, as well as information from an analysis conducted in a laboratory 8. If desired, tank information and blend specifications for the gasoline in the product tank can also be provided to the computer. Samples can be drawn from the gasoline product tank, for example, at 9, for laboratory testing.

Once the feed stock is blended, it can be mixed directly with the desired amount of ethanol for which the feed stock has been blended, or simply transported, e.g., through a pipeline, to a terminal. Mixing of the ethanol with the feed stock can then be accomplished at the terminal in accordance with the present invention.

EXAMPLES

Several blended gasoline feed stocks were made to create a model. The various component streams used were conventional gasoline component streams including:

(i) whole alkylate;

(ii) FCC gasoline;

(iii) hydrobate;

(iv) pentane/hexane isomerate;

(v) heavy reformate;

(vi) hydrotreated FCCL; and (vii) alkylate.

In a blending system, all of the foregoing component streams are preferably provided from the same refinery. However, any one of the streams used can be provided from an outside source, but it is preferred for the present invention that the component streams originate as streams in the refinery on site. For the present examples, small samples were used on a laboratory scale in order to create a model.

The characteristics of such various component streams are provided in Table 2 below. The relative amounts of each component in each blended feed stock for the examples is also provided in Table 3.

Once each of the blend stocks were made, it was mixed with 2% by volume, 4%, 6% and 10% ethanol. The resulting final gasoline specifications were then measured and are reported in Table 4 below. The results are graphically presented in FIGS. 2–13. Table 4 and the graphs of FIGS. 2–13 can be used as a model in determining an appropriate amount of ethanol to be blended with a particular blend stock.

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A method for blending unleaded gasoline having an RVP of 8.0 psi or less, which comprises providing a substantially oxygenate free unblended gasoline blend stock which has an RVP of no greater than 7.0 psi; and adding ethanol to the gasoline blend stock in an amount such that the final gasoline meets the California Phase 3 Predictive Model, with the unleaded gas to which the ethanol is added having a temperature at which 50% is distilled (T50) sufficiently high such that the ethanol addition does not cause T50 value to drop below the ASTM D 4814 minimum requirement of 170° F.

2. The method of claim 1, wherein the RVP of the substantially oxygenate free blend stock is no greater than 6.5 psi.

3. The method of claim 1, wherein the RVP of the oxygenate free gasoline blend stock is no greater than 6.0 psi.

4. The method of claim 1, wherein the RVP of the substantially oxygenate free gasoline blend stock is in the range from about 6.0–7.0 psi.

5. The method of claim 1, wherein the RVP of the substantially oxygenate free gasoline blend stock is in the range from about 6.0–6.5 psi.

6. The method of claim 1, wherein the RVP of the substantially oxygenate free gasoline blend stock is in the range from about 5.5–6.0 psi.

7. The method of claim 1, wherein the final unleaded gasoline has an RVP of 7.5 psi or less.

8. The method of claim 1, wherein the RVP of the final gasoline is 7.0 psi or less.

9. The method of claim 1, wherein the amount of ethanol added to the gasoline blend stock is at least 2.0 vol. % based on the final gasoline.

10. The method of claim 1, wherein the amount of ethanol added to the gasoline blend stock is in an amount of at least 4.0 vol. %.

11. The method of claim 1, wherein the amount of ethanol added to the gasoline blend stock is in an amount of at least 6.0 vol. % based upon the final gasoline.

12. The method of claim 1, wherein the ethanol is added to the gasoline blend stock at a location different from the location at which the blend stock was blended.

13. The method of claim 1, wherein a model is created for blending ethanol with the blend stock, and the blending is conducted consistent with the model.

* * * * *